US006217415B1

(12) United States Patent
Ajayi

(10) Patent No.: US 6,217,415 B1
(45) Date of Patent: Apr. 17, 2001

(54) METHOD AND ARRANGEMENT FOR REDUCING FRICTION BETWEEN METALLIC COMPONENTS

(75) Inventor: Oyelayo Ajayi, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/286,956

(22) Filed: Apr. 6, 1999

(51) Int. Cl.[7] ..... B24B 1/04

(52) U.S. Cl. ..... 451/35; 451/33; 451/53; 451/54

(58) Field of Search ..... 451/35, 85, 33, 451/53, 54; 83/14

(56) References Cited

U.S. PATENT DOCUMENTS

| | | | | |
|---|---|---|---|---|
| 1,678,359 | * | 7/1928 | Schulte | 451/35 |
| 2,185,262 | * | 1/1940 | Lupo | 451/35 |
| 2,439,156 | * | 4/1948 | Castle | 451/35 |
| 4,235,051 | * | 11/1980 | Spekman, Jr. | 451/35 |

FOREIGN PATENT DOCUMENTS

| | | | | |
|---|---|---|---|---|
| 1275061 | * | 12/1986 | (RU) | 451/35 |

OTHER PUBLICATIONS

Materials Handbook, 14th Edition, by Brady, Clauser, and Vaccari, 1997.*

* cited by examiner

*Primary Examiner*—Joseph J. Hail, III
*Assistant Examiner*—George Nguyen
(74) *Attorney, Agent, or Firm*—Maginot, Addison & Moore

(57) ABSTRACT

A method for treating a surface of a first metallic component with an arrangement that includes (i) a receptacle, (ii) a polishing media located within the receptacle, and (iii) a mixing device operative to cause relative movement between the polishing media and the first metallic component is disclosed. The method includes the following steps (i) positioning the first metallic component within the receptacle so that the surface of the first metallic component is in contact with the polishing media, (ii) actuating the mixing device such that the mixing device causes relative movement between the polishing media and the surface of the first metallic component so that the polishing media polishes the surface of the first metallic component, and (iii) placing a chemical agent within the receptacle so that the chemical agent is in contact with the surface of the first metallic component at the same time the surface of the first metallic component is in contact with the polishing media such that the chemical agent causes an adherent chemical layer to be disposed on the surface of the first metallic component, wherein the adherent chemical layer reduces friction between the surface of the first metallic component and a surface of a second metallic component when the surfaces are in contact with each other. An associated arrangement is also disclosed.

15 Claims, 7 Drawing Sheets

METHOD AND ARRANGEMENT FOR REDUCING FRICTION BETWEEN METALLIC COMPONENTS

TECHNICAL FIELD OF THE INVENTION

The present invention relates generally to a method and arrangement for treating or conditioning a metallic surface, and more particularly to a method and arrangement for reducing friction between metallic components thereby increasing their reliability and durability.

BACKGROUND OF THE INVENTION

During use, work machine components, such as gears of a crawler tractor, typically fail and must be replaced or reconditioned after a certain period of time. The replacement or reconditioning of these components increases the maintenance cost of the work machine.

The failure of the aforementioned components is usually due to the scuffing, wear, or pitting of a surface thereof, e.g. the surface of a gear tooth. Often more than one of these three failure modes (i.e. scuffing, wear, or pitting) occur concurrently to significantly decrease the "life" of the work machine component. The rate at which scuffing, wear, or pitting occurs on the surface of the work machine component is dependent on the amount of friction between the surface of the work machine component and a contacting surface of another work machine component. For example, the rate at which meshingly engaged gear teeth scuff, wear, or pit is dependent on the amount of friction between the contact surfaces of the gear teeth. Therefore, it is desirable to decrease the friction between the contacting surfaces of work machine components so as to decrease the rate at which they scuff, wear, or pit.

Heretofore, mechanical polishing has been utilized to decrease friction between the contacting surfaces of work machine components. In particular, the contacting surfaces are polished so as to remove surface irregularities thereby making the surfaces extremely smooth. Making oil lubricated contacting surfaces smooth reduces the friction therebetween. However, even after extensive mechanical polishing, microscopic surface irregularities (i.e. asperities) will still be present on the contacting surfaces of the work machine components. Therefore, even after mechanical polishing, there is a significant amount of friction between the contacting surfaces of work machine components due to the aforementioned microscopic surface irregularities. The local friction caused by these microscopic surface irregularities can cause the premature failure of the work machine components.

To address the above described drawback of mechanical polishing, various chemical additives have been added to lubricating oils so as to form a surface chemical film on the contacting surfaces of the work machine components. These surface chemical films allow "boundary lubrication" to occur between the contacting surfaces of work machine components. The occurrence of boundary lubrication further reduces the friction between contacting surfaces and increase the durability of work machine components as compared to the friction reduction obtained with mechanical polishing alone.

However, a drawback to using these chemical additives in a lubricating oil is the lack of control of the boundary lubrication on the surface of the work machine component. Another drawback to using these chemical additives in a lubricating oil is the that the lubricating oil must be in contact with the work machine component for a significant period of time before a surface chemical film can be disposed on the contacting surfaces. During the time it takes for the surface chemical film to be disposed on the contacting surfaces of the work machine components the work machine should not be utilized to its full capacity. In other words, during this "break in period" (i.e. the period of time it takes for the surface chemical film to be disposed on the contacting surfaces of the work machine components), the work machine should only be operated in a somewhat gingerly manner. For example, during the break in period the engine of the work machine should only be operated under a predetermined RPM (revolutions per minute) limit. While this break in period allows the surface chemical film to be formed on the contacting surfaces of the work machine components, it is inconvenient for the operator of the work machine. In addition, not adhering to the various constraints of the break in period can lead to the premature failure of work machine components.

What is needed therefore is a method and arrangement for reducing friction between metallic components which overcomes one or more of the above-mentioned drawbacks.

DISCLOSURE OF THE INVENTION

In accordance with a first embodiment of the present invention, there is provided a method for treating a surface of a first metallic component with an arrangement that includes (i) a receptacle, (ii) a polishing media located within the receptacle, and (iii) a mixing device operative to cause relative movement between the polishing media and the first metallic component. The method includes the following steps (i) positioning the first metallic component within the receptacle so that the surface of the first metallic component is in contact with the polishing media, (ii) actuating the mixing device such that the mixing device causes relative movement between the polishing media and the surface of the first metallic component so that the polishing media polishes the surface of the first metallic component, and (iii) placing a chemical agent within the receptacle so that the chemical agent is in contact with the surface of the first metallic component at the same time the surface of the first metallic component is in contact with the polishing media such that the chemical agent causes an adherent chemical layer to be disposed on the surface of the first metallic component, wherein the adherent chemical layer reduces friction between the surface of the first metallic component and a surface of a second metallic component when the surfaces are in contact with each other.

In accordance with a second embodiment of the present invention, there is provided a arrangement for reducing friction between a surface of a first metallic component and a surface of a second metallic component. The arrangement includes a receptacle for receiving the first metallic component. The arrangement also includes a polishing media located within the receptacle such that the polishing media is in contact with the surface of the first metallic component. The arrangement further includes a mixing device operative to cause relative movement between the polishing media and the first metallic component. The arrangement also includes a chemical agent disposed within the receptacle so that the chemical agent is in contact with the surface of the first metallic component at the same time the surface of the first metallic component is in contact with the polishing media such that the chemical agent causes an adherent chemical layer to be disposed on the surface of the first metallic component, wherein the adherent chemical layer reduces friction between the surface of the first metallic component and the surface of the second metallic component when the surfaces are in contact with each other.

BEST MODE FOR CARRYING OUT THE INVENTION

Figure 1:
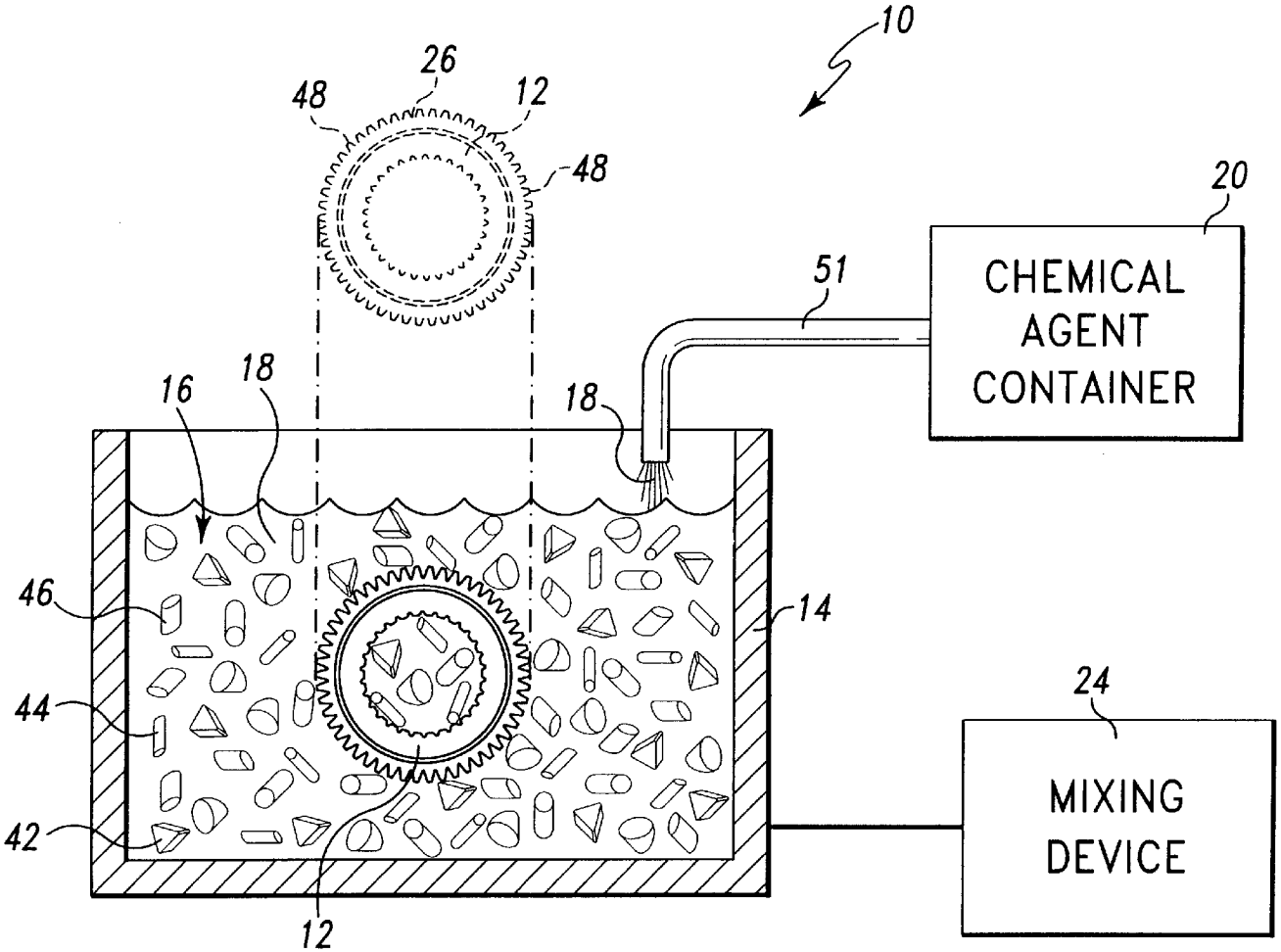
FIG. 1 is a schematic representation of an arrangement for reducing friction between metallic components that incorporates the features of the present invention therein.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Referring now to FIGS. 1 and 2A–2D, there is shown an arrangement 10 for reducing friction between a surface 26 of a first metallic component 12 of a work machine (not shown) and a surface 36 of a second metallic component 38 (see FIG. 2D) of the work machine. Note that first metallic component 12 can be a gear as shown in FIG. 1, with surface 26 being defined on a gear tooth 48 of the gear. In addition, second metallic component 38 (see FIG. 2D) can also be a gear identical to the aforementioned gear, with surface 36 being defined on a gear tooth 50 of the gear. However, it should be understood that first metallic component 12 and second metallic component 38 can be any metallic components that are involved in a frictional contact relationship. For example, first metallic component 12 and second metallic component 38 could also be a cam and a poppet valve, respectively.

The arrangement 10 includes a receptacle 14, a mixing device 24, a chemical agent container 20, a chemical agent 18, and a polishing media 16. Mixing device 24 is operatively coupled to receptacle 14 such that, when actuated, mixing device 24 causes relative movement between polishing media 16 and first metallic component 12 when polishing media 16 and first metallic component 12 are located within receptacle 14. For example, mixing device 24 can be a vibrating mechanism which causes the vibration of receptacle 14, and thus causes the vibration of any object (e.g. polishing media 16 and first metallic component 12) placed within receptacle 14.

Chemical agent container 20 is coupled to, and in fluid communication with, a conduit 51. Chemical agent container 20 and conduit 51 are positioned relative to receptacle 14 such that the chemical agent 18 disposed within chemical agent container 20 can be transferred to receptacle 14 as clearly shown in FIG. 1.

Figure 6A:
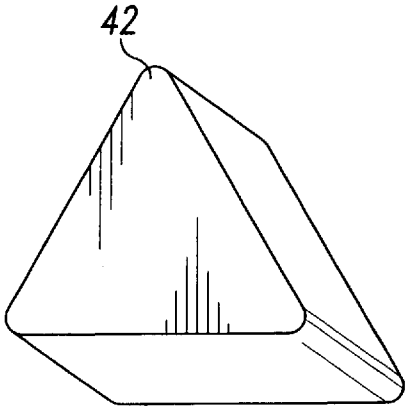
FIGS. 6A–6D are perspective views of ceramic polishing elements which are used in the arrangement of FIG. 1.
Figure 6B:
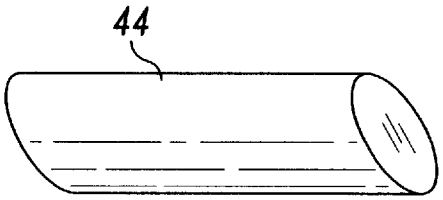
Figure 6C:
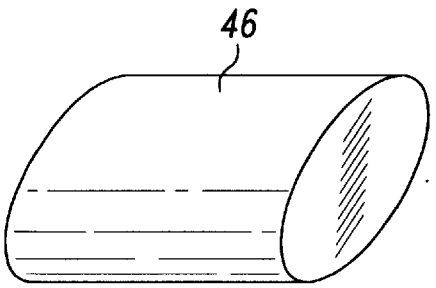
Figure 6D:
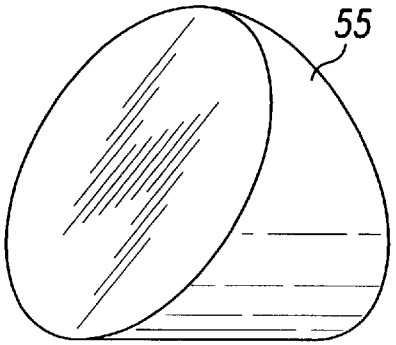

Polishing media 16 includes a number of polishing elements 42, 44, and 46. As shown more clearly in FIGS. 6A–6C, each of polishing elements 42, 44 and 46 has a distinct shape. In particular, as shown in FIG. 6A, polishing element 42 has the shape of a triangle. As shown in FIG. 6B, polishing element 44 has the shape of an oblique cylinder. As shown in FIG. 6C, polishing element 46 also has the shape of an oblique cylinder. Furthermore, as shown in FIG. 6D, polishing media 16 can include a polishing element 55 which has the shape of a truncated cylinder. In addition, the polishing media 16 of the present invention can include polishing elements having shapes other than those discussed above. Moreover, polishing media 16 can include polishing elements which all have the same shape. Preferably, all of the polishing elements of polishing media 16 are made from a ceramic material.

Figure 7:
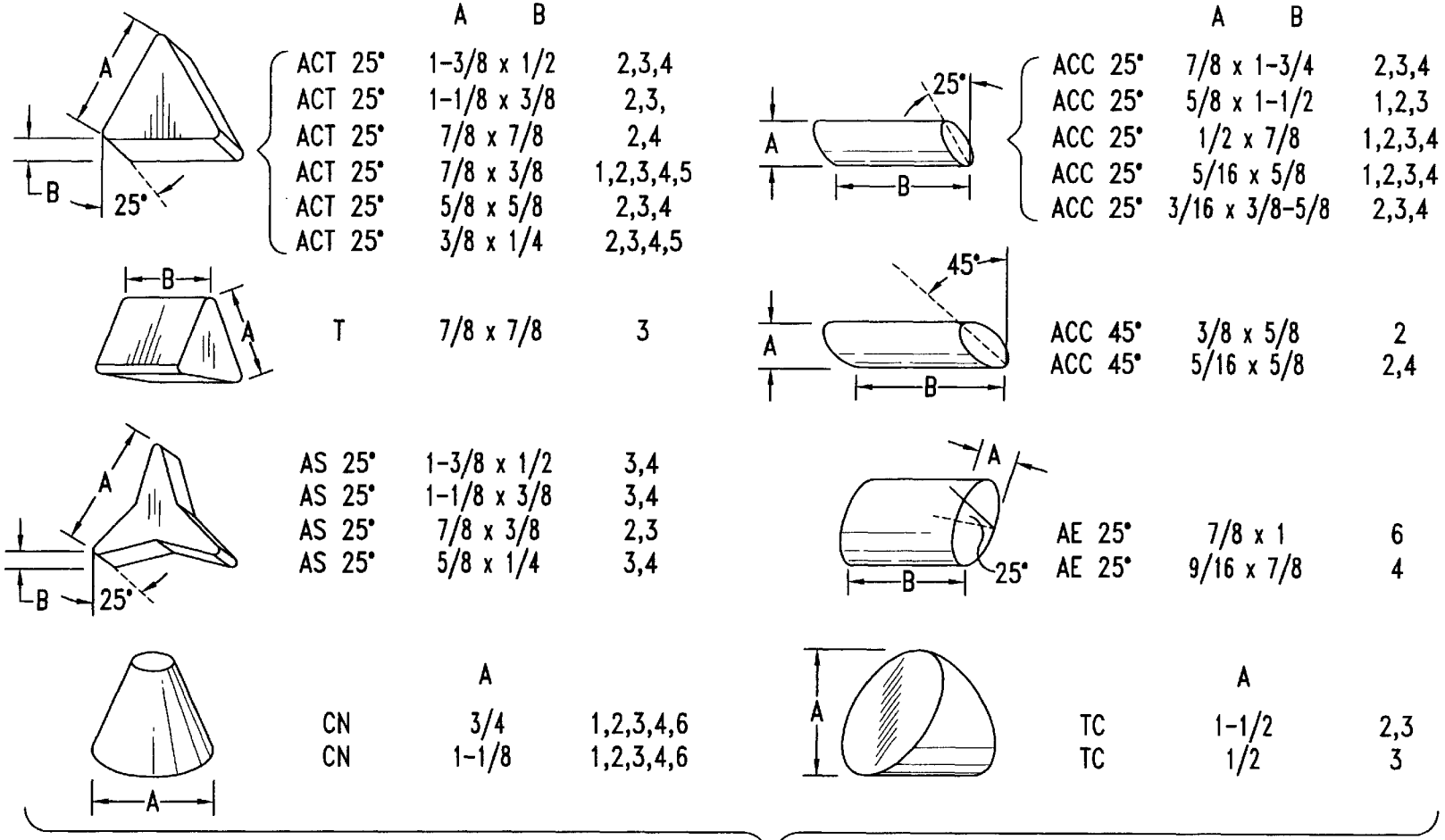
FIG. 7 is a table depicting various physical characteristics of the polishing elements utilized in the arrangement of FIG. 1.

The above described polishing elements are commercially available from REM Chemicals, Inc. located in Southington, Conn. In particular, polishing elements 42, 44, 46, 55, and others can be obtained from REM Chemicals by utilizing the information (i.e. product numbers) presented in FIG. 7. As shown in FIG. 7, several different "types" of polishing element 42 are available from REM Chemicals, and each of these types has different physical characteristics (e.g. size). For example, polishing element 42 comes in a type which is described by the product number ACT 25° 1⅜×½ 2,3,4, in the alternative polishing element 42 is also available in a type described by product number ACT 25° 1⅛×⅜ 2,3 and one or both of these types could be utilized in a polishing media 16 of the present invention. When using more than one type of polishing element the types can be used in equal or unequal proportions.

It should be understood that, as shown in FIG. 1, a polishing media 16 having different shaped polishing elements contained therein can be made with polishing elements 42, 44, and 46 by mixing the aforementioned polishing elements. In addition, as mentioned above, a polishing media 16 which includes different types of polishing elements can be made. Moreover, it should be appreciated that a polishing media 16 having polishing elements other than those discussed above or shown in FIG. 1 can be made by mixing other polishing elements available from REM Chemicals. For example, a polishing media 16 having a polishing element with the shape of a truncated cone (available from REM Chemicals as product number CN ¾ 1,2,3,4,6) can be included in the polishing media 16.

Equal proportions of the variously shaped polishing elements can also be used in polishing media 16. For example, one combination of polishing elements 44, 46, and 42 for polishing media 16 which can be used in the present invention includes product number ACC 25° ½×⅞ 1,2,3,4 as polishing element 44; product number AE 25° ⅞×1 6 as polishing element 46; and product number ACT 25° 1⅜×½ 2,3,4 as polishing element 42, with each polishing element 44, 46, and 42 being present in equal ⅓ proportions. However, unequal proportions of the polishing elements can also be utilized.

Chemical agent 18 is placed within receptacle 14 along with polishing media 16 so that chemical agent 18 is in contact with surface 26 of first metallic component 12 at the same time surface 26 is in contact with polishing media 16. Chemical agent 18 possesses chemical properties such that when chemical agent 18 is in contact with surface 26, chemical agent 18 chemically reacts with surface 26 and causes an effective amount of an adherent chemical layer 34 (see FIG. 2C) to be disposed on surface 26 of first metallic component 12 such that adherent chemical layer 34 reduces friction between surface 26 of first metallic component 12 and surface 36 of second metallic component 38 when surfaces 26 and 36 are in contact with each other and in a frictional relationship.

It should be understood that when chemical agent 18 chemically reacts with surface 26, the chemical compounds or chemical elements (e.g. sulfur, zinc, phosphorous) contained within chemical agent 18 become directly or indirectly chemically bonded to surface 26 such that the chemical elements included in adherent chemical layer 34 can not be easily removed from surface 26. For example, the chemical compounds or chemical elements bonded to surface 26 after treatment with chemical agent 18 would not be removed by a simple aqueous wash of surface 26. Preferably, when chemical agent 18 reacts with surface 26, chemical compounds or elements present in chemical agent 18 react with the chemical constituents of surface 26 such that the aforementioned chemical compounds or elements participate in a physisorption process. A physisorption process is a physical adsorption process in which there are van derwaals forces of interaction between the chemical constituents of chemical agent 18 and the chemical constituents of surface 26. It is more preferable that when chemical agent 18 reacts with surface 26, chemical compounds or elements present in chemical agent 18 react with the chemical constituents of surface 26 such that the aforementioned chemical compounds or elements participate in a chemisorption process. A chemisorption process occurs when the chemical constituents of chemical agent 18 react with the chemical constituents of surface 26 to form strong chemical bonds therebetween, for example covalent bonds.

Preferably, chemical agent 18 is a liquid, however, chemical agent 18 can also be a solid which is dissolved in an appropriate solvent (e.g. acetone or an alcohol).

Examples of chemical agent 18 include alkyl polysulfides, aryl polysulfides, halogenated hydrocarbons such as chlorinated hydrocarbons, and sulfurized alkenes such as sulfurized oleic acid or sulfurized isobutylene. What is meant herein by a "sulfurized" compound, e.g. sulfurized alkenes, is a compound with one or more sulfur atoms in which the sulfur is connected directly to a carbon atom. For example, a sulfurized compound can contain one or more sulfhydryl (—SH) or sulfate groups (—$SO_4$). Also what is meant herein by the term "hydrocarbon" is a chemical group based on carbon chains or rings which include hydrogen. It should also be understood that "hydrocarbon" as used herein also includes chemical groups based on carbon chains or rings which contain hydrogen along with one or more of the following elements: oxygen, nitrogen, sulfur, phosphorus, a halogen, or any other element. The above described compounds are well known in the art and are commercially available from sources such as the Sigma Corporation located in St. Louis, Mo., the Aldrich Corporation located in Milwaukee, Wis., the Lubrizol Corporation located in Wickliffe, Ohio, or King Industries located in Norwalk, Conn. For example, sulfurized alkenes are commercially available from the Lubrizol Corporation as product "Anglamol 33" or from King Industries as product "NA-Lube EP-5915".

Additional examples of chemical agent 18 include organic phosphates having the following formula:

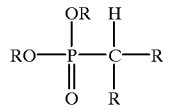

where R is the same or different and is hydrogen and a hydrocarbon. In particular, the aforementioned hydrocarbon can be selected from the group consisting of an alkane, an alkene, an alkyne, an alkoxy, an aryl, a cycloalkane, a cycloalkene, or a cycloalkyne. The above described organic phosphates are well known in the art and are commercially available from various commercial sources. For example, the organic phosphate isopropyl phenol phosphate is commercially available from the FMC Corporation located in Philadelphia, Pennsylvania, as product "Durad 300".

Further examples of chemical agent 18, include organic sulfates having the following formula:

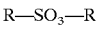

where R is the same or different and is hydrogen and a hydrocarbon. In particular, the aforementioned hydrocarbon can be selected from the group consisting of an alkane, an alkene, an alkyne, an alkoxy, an aryl, a cycloalkane, a cycloalkene, or a cycloalkyne. The above described organic sulfates are well known in the art and are commercially available from the various aforementioned commercial sources.

In addition, chemical agent 18 can include an organic borate such as an alkane borate, an alkene borate, an alkyne borate, an aryl borate, a cycloalkane borate, a cycloalkene borate, or a cycloalkyne borate. The above described organic borates are well known in the art and are commercially available from the various aforementioned commercial sources. For example, the aryl borate tribenzyl borate is commercially available from the Aldrich Corporation as product number S372412.

Chemical agent 18 can also include phosphoric acid tris(methylphenyl) ester (also known as TCP or Tri-Cresyl-Phosphate) which has the following formula:

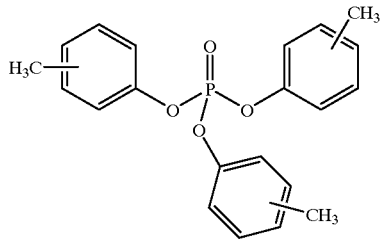

Phosphoric acid tris(methylphenyl) ester is commercially available from the Aldrich Corporation as product number 268917.

Chemical agent 18 can also include zinc dialkyl dithiophosphates having the formula:

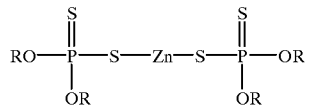

where R is the same or different and is hydrogen and a hydrocarbon. In particular, the aforementioned hydrocarbon can be selected from the group consisting of an alkane, an alkene, an alkyne, an alkoxy, an aryl, a cycloalkane, a cycloalkene, or a cycloalkyne. The above described zinc dialkyl dithiophosphates are well known in the art and are commercially available from the various aforementioned commercial sources. For example zinc dialkyl dithiophosphate is commercially available from the Lubrizol Corporation as product "Lubrizol 677A" or "Lubrizol 1395".

Chemical agent 18 can also include zinc dialkyl dithiocarbamates having the formula:

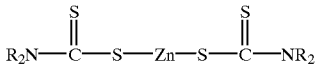

where R is the same or different and is hydrogen and a hydrocarbon. In particular, the aforementioned hydrocarbon can be selected from the group consisting of an alkane, an alkene, an alkyne, an alkoxy, an aryl, a cycloalkane, a cycloalkene, or a cycloalkyne. The above described zinc dialkyl dithiocarbamates are well known in the art and are commercially available from the various aforementioned commercial sources. For example, zinc dialkyl dithiocarbamate is commercially available from R.T. Vanderbilt Co., Inc. located in Norwalk, Connecticut as product Vanlube AZ.

It should be understood that chemical agent 18 can include any one of the above described chemical compounds, or a mixture of these compounds, depending upon the type of failure mode the metallic component is subjected to during its use. For example, preferably, phosphoric acid tris(methylphenyl) ester, sulfurized alkenes (in particular sulfurized oleic acid), alkyl polysulfides, aryl polysulfides, organic phosphates, organic sulfates, and/or halogenated hydrocarbons (in particular chlorinated hydrocarbons) are included in chemical agent 18 to inhibit scuffing of a metallic component (e.g. first metallic component 12) of the work machine. Scuffing, as used herein, is defined as the severe plastic deformation of a first surface of a first metallic component when the first surface comes into a high load contact with a second surface of another component. In addition, it is preferable that zinc dialkyl dithiophosphates, phosphoric acid tris(methylphenyl) ester, sulfurized alkenes, organic borates, and/or halogenated hydrocarbons (in particular chlorinated hydrocarbons) are included in chemical agent 18 to inhibit the wear of a metallic component of the work machine. Wear, as used herein, is defined as the removal or erosion of material from a surface of a metallic component. Furthermore, it is preferable that zinc dialkyl dithiocarbamates are included in chemical agent 18 to inhibit the pitting of a metallic component of the work machine. Pitting, as used herein, is defined as contact fatigue of a surface of metallic component, where eventually cracks form in the surface eventually resulting in the loss of relatively large amounts of material from the surface so as to cause "pits" therein.

INDUSTRIAL APPLICABILITY

During use of arrangement 10, as shown in FIG. 1, first metallic component 12 is positioned in receptacle 14 along with polishing media 16. Chemical agent 18 is then released from chemical agent container 20 such that chemical agent 18 is also positioned within receptacle 14 along with first metallic component 12 and polishing media 16. Placing first metallic component 12, polishing media 16, and chemical agent 18 in the above described manner results in chemical agent 18 and polishing media 16 being in contact with first metallic component 12 at the same time. It should be understood that when polishing media 16 and first metallic component 12 are placed in receptacle 14, the volume occupied by polishing media 16 should be about ten fold larger than the volume occupied by first metallic component 12. Furthermore, it should be understood that when chemical agent 18 is placed in receptacle 14 along with polishing media 16 and first metallic component 12, the volume occupied by chemical agent 18 should be about %15 of the total volume of the first metallic component 12 and the polishing media 16.

This relationship can be expressed mathematically as follows:

$$\frac{Vol.\ CA}{(Vol.\ FMC + Vol.\ PM)} \times 100 = \%\,15$$

where Vol. CA is the volume occupied by chemical agent 18, Vol. FMC is the volume occupied by first metallic component 12, and Vol. PM is the volume occupied polishing media 16. However, it should be appreciated that chemical agent 18 is preferably dispersed in an appropriate carrier liquid or solvent (e.g. an appropriate organic solvent, such as mineral oil) such that first metallic component 12 and polishing media 16 are substantially submerged in the appropriate carrier liquid and chemical agent 18. Note that the volume of carrier liquid and chemical agent 18 shown in FIG. 1 is some what exaggerated for clarity of description. If chemical agent 18 is a solid then it must be thoroughly dispersed in a carrier liquid such as mineral oil as the same procedure used as if the chemical agent 18 was a liquid.

Figure 2B:
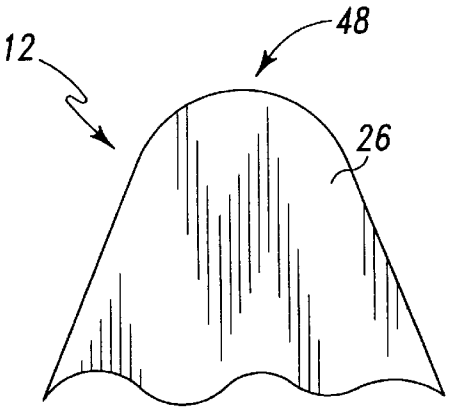
FIG. 2B is a view similar to the one illustrated in FIG. 2A, but showing the gear tooth after being polished by the arrangement of FIG. 1.

Once first metallic component 12, polishing media 16, and chemical agent 18 are disposed in receptacle 14 in the above described manner mixing device 24 is actuated such that mixing device 24 causes relative movement between first metallic component 12 and polishing media 16. In addition, mixing device 24 causes polishing media 16 to bump and slide against surface 26 of first metallic component 12 such that surface 26 is polished. In particular, the aforementioned interaction between surface 26 of first metallic component 12 and polishing media 16 results in polishing media 16 removing irregularities 57 (see FIG. 2A) from surface 26 so that surface 26 becomes relatively smooth (i.e. relatively free of irregularities 57) as shown in FIG. 2B.

Figure 2D:
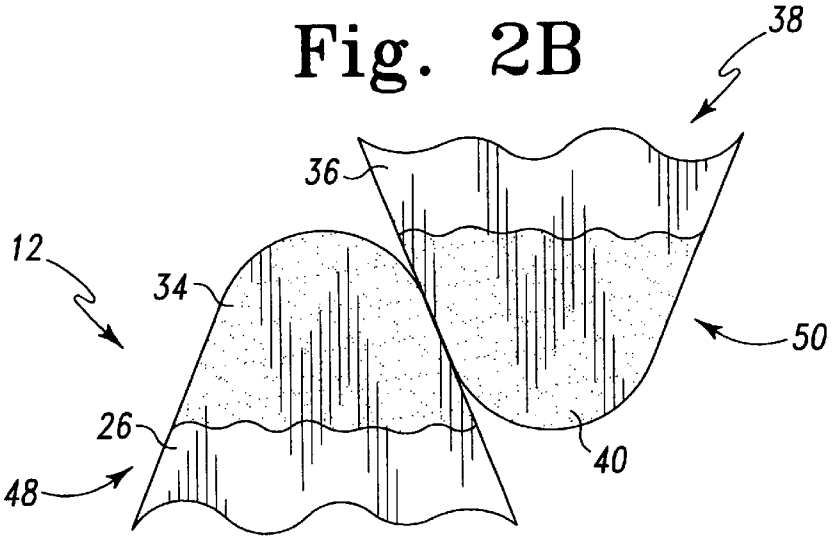
FIG. 2D is a view similar to FIG. 2C, but showing the gear tooth meshingly engaged with another gear tooth which has another adherent chemical layer disposed thereon by the arrangement of FIG. 1 (note that only a portion of the gear tooth is shown with the adherent chemical layer disposed thereon for clarity of description)
Figure 2A:
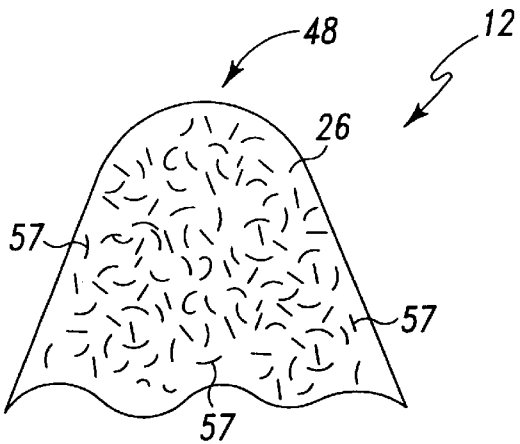
FIG. 2A is an enlarged fragmentary view of a tooth of the gear illustrated in FIG. 1 showing the gear tooth prior to being polished by the arrangement of FIG. 1.
Figure 2C:
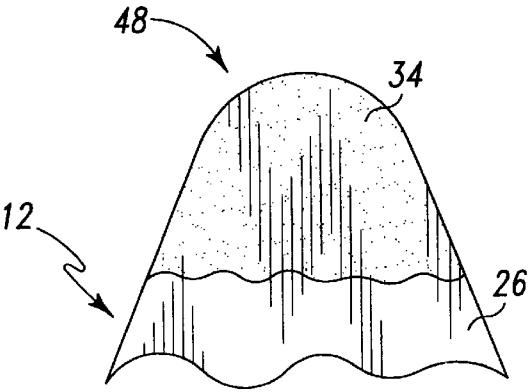
FIG. 2C is a view similar to FIG. 2B, but showing the gear tooth after the adherent chemical layer has been disposed thereon by the arrangement of FIG. 1 (note that only a portion of the gear tooth is shown with the adherent chemical layer disposed thereon for clarity of description)

In addition to removing irregularities 57, the aforementioned interaction between surface 26 of first metallic component 12 and polishing media 16 also facilitates the deposition of adherent chemical layer 34 onto surface 26 as shown in FIG. 2C. Therefore, utilizing arrangement 10 in the above described manner allows chemical layer 34 to be deposited onto surface 26 after about 2 hours of processing in receptacle 14.

Other metallic components of the work machine can also be treated in the above described manner using arrangement 10. For example, second metallic component 38 can be treated using arrangement 10 so that an adherent chemical layer 40 is disposed onto surface 36 thereof as shown in FIG. 2D. Thus when tooth 48 of first metallic component 12 meshes with tooth 50 of second metallic component 38 as shown in FIG. 2D, "boundary lubrication" can occur between surface 26 of first metallic component 12 and surface 36 of second metallic component 38 as a result of both surfaces having an adherent chemical layer disposed thereon. Having boundary lubrication occurring between surface 36 and surface 26 reduces the friction between the contacting surfaces 26 and 36. Reducing the friction between contacting surfaces 26 and 36 is an advantage since by doing so the amount of scuffing, wear, or pitting of surfaces 26 and 36 is decreased. Decreasing the amount of scuffing, wear, or pitting extends the performance life of first metallic component 12 and second metallic component 38 thereby decreasing the maintenance costs for the work machine.

It should be appreciated that the aforementioned 2 hours of treatment of first metallic component 12 (or any other metallic components of the work machine) with arrangement 10 is equivalent to the previously mentioned "break in period" (i.e. the period of time a work machine must be used in a some what gingerly manner so that chemical additives in the lubricating oil have time to be deposited onto the surfaces of the metallic components of the work machine). Therefore, the previously discussed drawbacks of uncontrollable activity of utilizing chemical additives in the lubricating oil during the "break in period" are avoided. In addition, utilizing arrangement 10 in the above described manner eliminates the requirement that the lubricating oil be in contact with a metallic work machine component for a significant period of time before an adherent chemical layer can be disposed thereon. Thus, the work machine can be immediately utilized to its full capacity, thereby avoiding any need for a break in period, since the adherent chemical layer 34 was disposed on the metallic components of the work machine (e.g. first metallic component 12) by utilizing arrangement 10 in the above described manner. Note that all of the appropriate metallic components of the work machine should be treated with arrangement 10 before the "break in period" can be avoided.

Arrangement 10 was utilized in the above described manner to process a test metallic component. Specifically, zinc dialkyl dithiophosphate was used as chemical agent 18 and product number ACC 25° ½×⅞ 1,2,3,4 as polishing element 44; product number AE 25° ⅞×1 6 as polishing element 46; and product number ACT 25° 1⅜×½ 2,3,4 as polishing element 42, with each polishing element 44, 46, and 42 being present in equal ⅓ proportions. The test metallic component was processed in receptacle 14 for about 2 hours at room temperature. After about 2 hours of processing, the test metallic component was removed from receptacle 14, and the surface 26 thereof cleaned. The surface 26 of the test metallic component was then subjected to analysis in order to ascertain the chemical characteristics of the adherent chemical layer 34 disposed thereon.

In particular, the surface 26 of test metallic component was subjected to Auger Electron Spectroscopy which is a known spectroscopic technique and thus will not be described in detail herein. However, a brief description of Auger Electron Spectroscopy is as follows. When the surface of a material sample is bombarded by energetic electrons, several events occur concurrently due to the interaction of the incoming electrons and the atoms of the sample. Various kinds of electrons are emitted from the sample, in addition to some radiation. Using appropriate detectors, the signals produced by these events provide information on the nature and identity of the chemical elements on the sample surface. Auger electrons are one of these emitted signals.

Figure 3A:
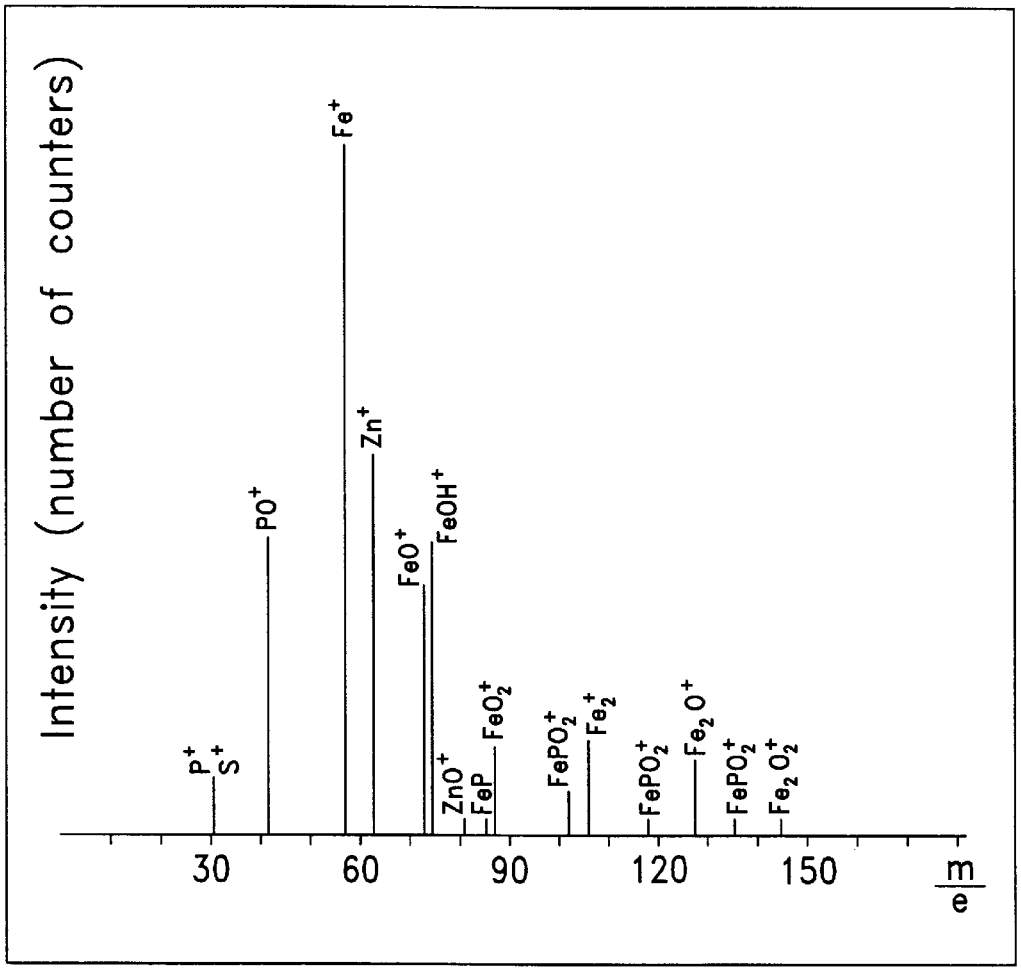
FIG. 3A is an Auger Electron Spectroscopy (AES) spectra of a test metallic component after under going treatment with the arrangement of FIG. 1.
Figure 3B:
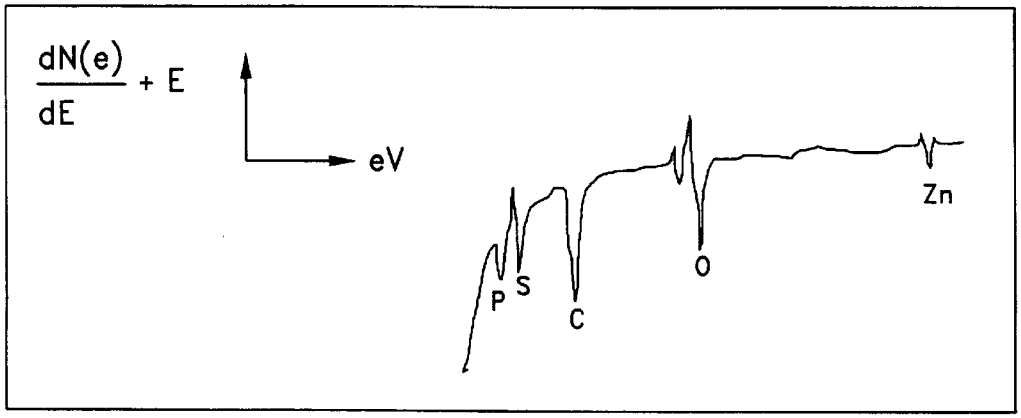
FIG. 3B is a Secondary Ion Mass Spectroscopy (SIMS) spectra of a test metallic component after under going treatment with the arrangement of FIG. 1.

During Auger analysis, the sample to be analyzed is put in a vacuum and bombarded with energetic electrons. A detector collects and analyzes the energy of the emitted Auger electrons. Each chemical element has a specific Auger electron energy. A spectrum with peaks corresponding to each of the elements present is generated by this analysis. FIG. 3B is the Auger spectra of the adherent chemical layer 34 formed on surface 26 of the test metallic component. The Auger spectrum shows that the elements present on the surface 26 of test metallic component are P, S, O, and Zn which is consistent with the chemical make up of an adherent chemical layer 34 which was disposed on surface 26 of the test metallic component by utilizing zinc dialkyl dithiophosphate as chemical agent 18.

Figure 4:
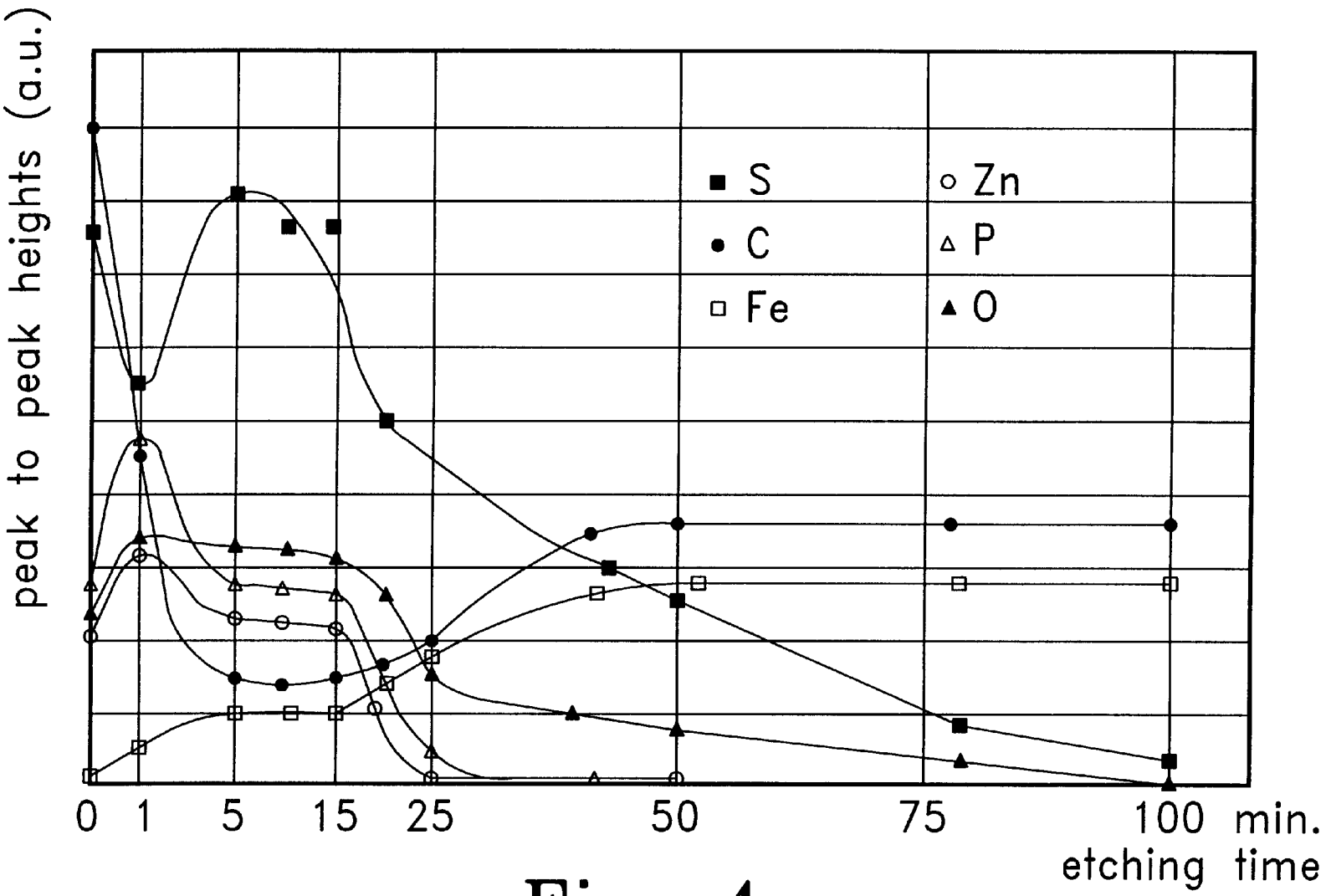
FIG. 4 is an Auger Electron Spectroscope (AES) profile of Auger spectra generated at pre-determined depth intervals from the surface of a test metallic component after under going treatment with the arrangement of FIG. 1.

To determine the chemical characteristics of the test metallic component just below the surface 26, material from the surface 26 was sputtered or etched in a known manner and the Auger spectra generated at pre-determined depth intervals. This approach was used to determine the variation of the chemical composition of adherent chemical layer 34 as a function of the depth from the surface 26 of the test metallic component. As shown in FIG. 4, each curve represents the relative amount of the indicated element (i.e. peak to peak heights) at a particular etch time, which corresponds to a particular depth from the surface. Note that the 0 minute etch time is the chemical composition of chemical layer 34 at the surface 26 of the test metallic component, whereas the 100 minute etch time corresponds to the chemical composition of chemical layer 34 at the a depth of about 1 micron below surface 26. These data are also consistent with the chemical make up of an adherent chemical layer 34 which was disposed on surface 26 of the test metallic component by utilizing zinc dialkyl dithiophosphate as chemical agent 18.

In addition, during the aforementioned sputtering or etching the mass of the chemical species removed from the surface 26 of the test metallic component was analyzed by Secondary Ion Mass Spectroscopy (SIMS) in a known manner. The SIMS spectrum which resulted from this analysis is shown in FIG. 3A. This SIMS spectrum shows the chemical state of P, S, C, O, and Zn present on the surface 26. This spectrum is also consistent with the chemical make up of an adherent chemical layer 34 which was disposed on surface 26 of the test metallic component by utilizing zinc dialkyl dithiophosphate as chemical agent 18.

Figure 5:
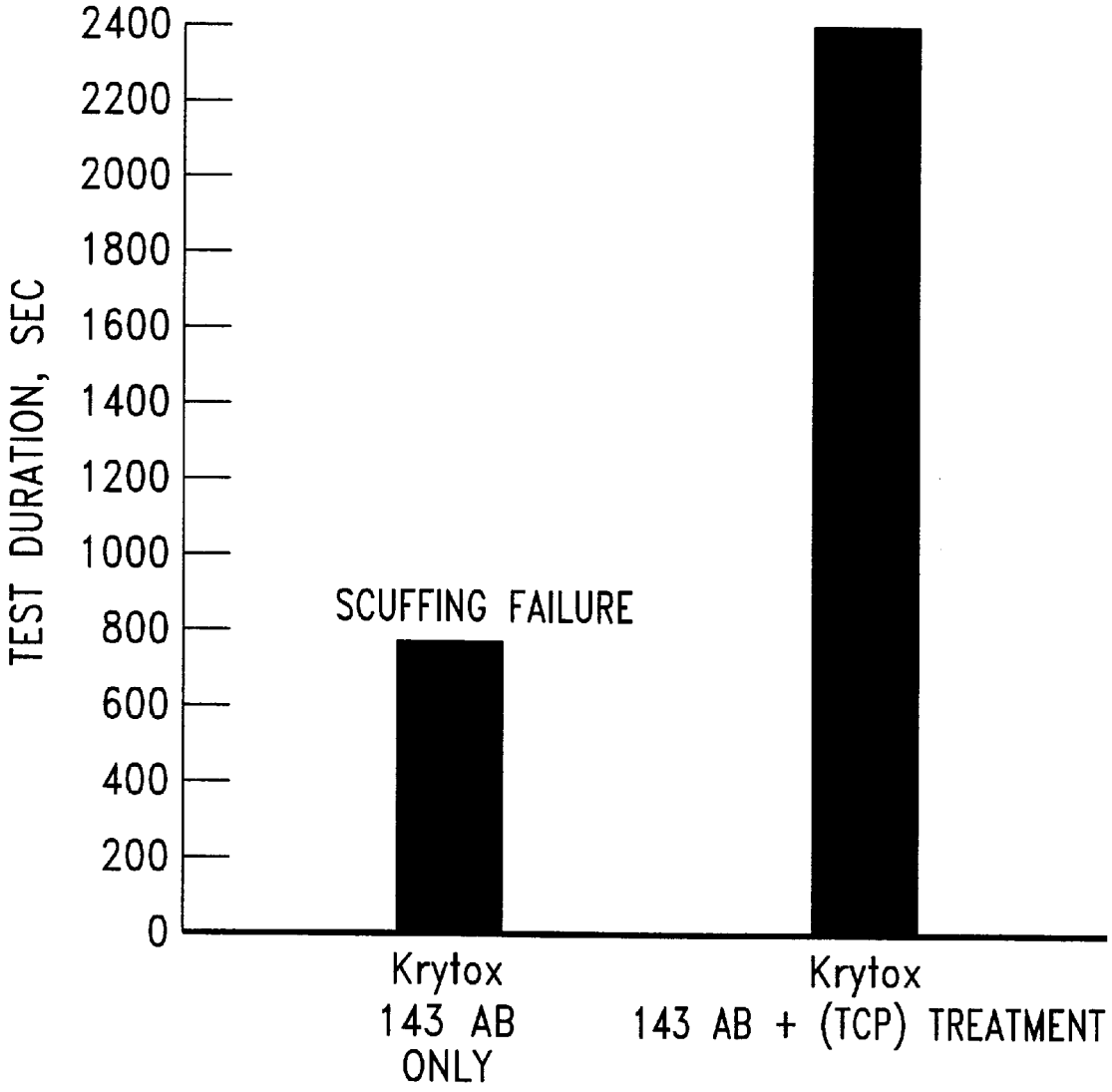
FIG. 5 is a graphic illustration depicting the enhanced wear performance of a test metallic component after under going treatment with the arrangement of FIG. 1.

As shown in FIG. 5, the ability of a test metallic component to resist scuffing is significantly enhanced by processing in arrangement 10. In particular, the above described procedure utilizing arrangement 10 was performed on 440C stainless steel specimens (a test metallic component) using phosphoric acid tris(methylphenyl) ester (also known as TCP) as chemical agent 18 and product number ACC 25° ½×⅞ 1,2,3,4 as polishing element 44; product number AE 25° ⅞×1 6 as polishing element 46; and product number ACT 25° 1⅜×½ 2,3,4 as polishing element 42, with each polishing element 44, 46, and 42 being present in equal ⅓ proportions. The test metallic components were processed in receptacle 14 for about 2 hours at room temperature. The processed 440C stainless steel specimens were then removed from receptacle 14 and subjected to a ball-on-disc test in the presence of Krytox 143 AB (a synthetic oil which does not contain any chemical additives which can form an adherent chemical layer 34 on the 440C stainless steel specimens). The ball-on-disc test was performed at a constant stress of 300 ksi between the ball and the disc, the sliding speed was progressively increased over time until scuffing occurred. The higher the sliding speed before scuffing (i.e. the greater the period of time the test can continue before scuffing), the better the scuffing performance of the 440C stainless steel specimen. An identical 440C stainless steel specimen which was not processed in arrangement 10 was also subjected to the ball-on-disc test under the same conditions. As shown in FIG. 5, the 440C stainless steel specimen which was not processed in arrangement 10 (indicated as "Krytox 143 AB" on the X axis of the bar graph shown in FIG. 5) suffered a scuffing failure at about 800 seconds. In contrast, the 440C stainless steel specimen which was processed in arrangement 10 (indicated as "Krytox 143 AB+(TCP) Treatment" on the X axis of the bar graph shown in FIG. 5) showed no scuffing failure during the entire time the ball-on-disc test was run (i.e. 2400 seconds). Thus, this ball-on-disc test demonstrates that processing the 440C stainless steel specimen in arrangement 10 significantly inhibits scuffing as compared to the 440C stainless steel specimen which was not processed in arrangement 10.

Other laboratory procedures which can be used to test the effectiveness of processing a metallic component in arrangement 10 so as to inhibit wear, scuffing, and/or pitting are described in the *Annual Book of ASTM Standards: Petroleum Products and Lubricants, American Society of Testing Materials, Philadelphia, Pa.,* (issued annually), the contents of which are incorporated herein by reference. For example, some of these procedures utilize a Timken machine, a Almen machine, a Falex machine, an SAE machine, or a 4-Ball machine.

While the invention has been illustrated and described in detail in the drawings and foregoing description, such illustration and description is to be considered as exemplary and not restrictive in character, it being understood that only the preferred embodiment has been shown and described and that all changes and modifications that come within the spirit of the invention are desired to be protected.

What is claimed is:

1. A method for treating a surface of a first metallic component with an arrangement that includes (i) a receptacle, (ii) a polishing media located within said receptacle, and (iii) a mixing device operative to cause relative movement between said polishing media and said first metallic component, said method comprising the steps of:

positioning said first metallic component within said receptacle so that said surface of said first metallic component is in contact with said polishing media;

actuating said mixing device such that said mixing device causes relative movement between said polishing media and said surface of said first metallic component so that said polishing media polishes said surface of said first metallic component;

placing a chemical agent including an alkyl polysulfide or an aryl polysulfide within said receptacle so that said chemical agent is in contact with said surface of said first metallic component at the same time said surface of said first metallic component is in contact with said polishing media; and disposing an adherent chemical layer on said surface of said first metallic component by chemically reacting said chemical agent with said surface of said first metallic component, wherein said adherent chemical layer reduces friction between said surface of said first metallic component and a surface of a second metallic component when said surfaces are in contact with each other.

2. The method of claim 1, wherein:

said chemical agent includes a halogenated hydrocarbon.

3. The method of claim 2, wherein:

said halogenated hydrocarbon is a chlorinated hydrocarbon.

4. The method of claim 1, wherein:

said chemical agent includes a sulfurized alkene.

5. The method of claim 4, wherein:

said sulfurized alkene is selected from the group consisting of sulfurized oleic acid or sulfurized isobutylene.

6. The method of claim 1, wherein:

said chemical agent includes a compound having the formula,

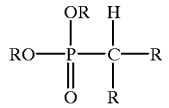

where R is the same or different and is hydrogen and a hydrocarbon.

7. The method of claim 6, wherein:

said hydrocarbon is selected from a group consisting of an alkane, an alkene, an alkyne, an alkoxy, an aryl, a cycloalkane, a cycloalkene, or a cycloalkyne.

8. The method of claim 1, wherein:

said chemical agent includes a compound having the formula,

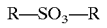

where R is the same or different and is hydrogen and a hydrocarbon.

9. The method of claim 8, wherein:

said hydrocarbon is selected from a group consisting of an alkane, an alkene, an alkyne, an alkoxy, an aryl, a cycloalkane, a cycloalkene, or a cycloalkyne.

10. The method of claim 1, wherein:

said chemical agent includes a compound which is selected from a group consisting of an alkane borate, an alkene borate, an alkyne borate, an aryl borate, a cycloalkane borate, a cycloalkene borate, or a cycloalkyne borate.

11. The method of claim 1 wherein:

said chemical agent includes a compound having the formula,

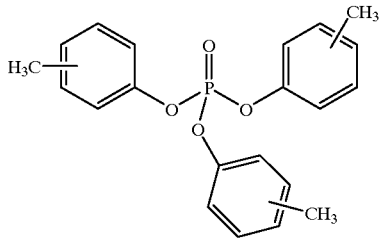

12. The method of claim 1, wherein:

said chemical agent includes a compound having the formula,

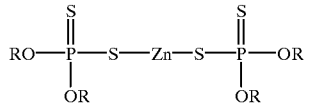

where R is the same or different and is hydrogen and a hydrocarbon.

13. The method of claim 12, wherein:

said hydrocarbon is selected from a group consisting of an alkane, an alkene, an alkyne, an alkoxy, an aryl, a cycloalkane, a cycloalkene, or a cycloalkyne.

14. The method of claim 1, wherein:
said chemical agent includes a compound having the formula,
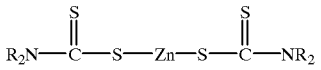
where R is the same or different and is hydrogen and a hydrocarbon.
15. The method of claim 14, wherein:
said hydrocarbon is selected from a group consisting of an alkane, an alkene, an alkyne, an alkoxy, an aryl, a cycloalkane, a cycloalkene, or a cycloalkyne.
* * * * *